US006253947B1

(12) United States Patent
Yang

(10) Patent No.: US 6,253,947 B1
(45) Date of Patent: Jul. 3, 2001

(54) CONTAINER WITH DETACHABLE SEALING CAP

(76) Inventor: Heng-Te Yang, P.O. Box 90, Tainan City (TW)

( * ) Notice: Subject to any disclaimer, the term of this patent is extended or adjusted under 35 U.S.C. 154(b) by 0 days.

(21) Appl. No.: 09/461,357

(22) Filed: Dec. 15, 1999

(51) Int. Cl.[7] ..... B65D 45/16

(52) U.S. Cl. ..... 220/324; 220/315; 220/378; 220/657; 220/659; 215/280; 215/271; 206/508

(58) Field of Search ..... 220/324, 326, 220/315, 657, 659, 604, 378; 215/273, 280, 286, 371; 206/503, 508, 512

(56) References Cited

U.S. PATENT DOCUMENTS

| | | | | |
|---|---|---|---|---|
| 3,868,041 | * | 2/1975 | Knize | 220/324 |
| 4,732,292 | * | 3/1988 | Supik | 220/604 X |
| 4,830,209 | * | 5/1989 | Jessop et al. | 215/273 |
| 5,065,885 | * | 11/1991 | Scaroni | 220/326 |
| 5,125,697 | * | 6/1992 | Kahl et al. | 220/324 X |
| 5,172,821 | * | 12/1992 | Knopf | 215/273 X |
| 5,535,910 | * | 7/1996 | Cassel | 220/212 |

FOREIGN PATENT DOCUMENTS

| | | | | |
|---|---|---|---|---|
| 1404411 | * | 8/1963 | (FR) | 220/324 |
| 668179 | * | 8/1963 | (CA) | 220/324 |

* cited by examiner

*Primary Examiner*—Allan N. Shoap
*Assistant Examiner*—Robin A. Hylton

(57) ABSTRACT

A sealable container includes a container body having two opposite curved grooves in an upper end and a recessed bottom wall; a cap having a flange for a seal gasket to fit around to seal an open mouth of the container, two U-shaped vertical walls defining a recess and having a ridge on two opposite sections; two plate hooks combined on the two U-shaped vertical walls, having a shove surface and two position plates in parallel; and a seal gasket. The cap can be taken off the container when the hooks are pushed outward, and kept sealed on the open mouth when the hooks are pushed inward. Two or more containers can be put on the other one by having the recessed bottom wall fitting with the convex upper surface of the cap and the two crescent grooves fitting with the shove surfaces of the hooks.

3 Claims, 7 Drawing Sheets

CONTAINER WITH DETACHABLE SEALING CAP

BACKGROUND OF THE INVENTION

This invention relates to a sealable container, particularly to one having two plate hooks respectively provided at two opposite sides of a cap of the container body to press tightly or loosen the cap to seal or free the cap on the container. The container has a recessed bottom wall in the bottom to fit with a convex upper surface of the cap and two opposite crescent grooves on two sides of the recessed bottom wall to fit with the shove surfaces of the two plate hooks so as to stabilize two containers put one on the other. A known conventional sealable container shown in FIG. 1 has a container body 10, a constrict ring 11 fitting around an annular groove 100 of the container body 10. The constrict ring 11 has a constrict member 110 to constrict itself. A seal gasket 13 is adhered on the bottom of a cap 12, which has an annular groove 120 for a position ring 14 to fit therein. The cap 12 is kept closed on the container 10 by means of a bent end 140 of the position ring 14 passing through and pivotally connected to a fix hole 111 of the constrict ring 11. In using the conventional sealable container 10, a U-shaped hook 112 of the constrict ring 11 is only swung up and engages a U-shaped ear 141 and a pusher 113 is swung up with the U-shaped hook 112 and pushed down, finishing sealing action of the cap 12 on the container body 10.

However, the known conventional sealable container uses different materials for its different components, resulting in a high cost and slow assembling process. In addition, in storing them they have to be put one on the other, so they are apt to fall down or sway to and fro in case of something touch or collide by accident, as the cap has a flat surface, as shown in FIG. 2.

SUMMARY OF THE INVENTION

A first objective of the invention is to offer a sealable container with a cap easily sealable on the container.

A second objective of the invention is to offer a sealable container possible to be piled up stabilized in storing.

A main feature of the invention is that it is consisted of a container body, a cap, a annular seal and two plate hooks. The container has two opposite curved grooves respectively in two upper sides, and the cap is closed on an upper mouth of the container body and has a flange formed in a bottom for the seal to fit around and a U-shaped vertical wall formed at two sides of the upper surface. The U-shaped vertical walls each define a recess, two side walls of the recess have a ridge. The two plate hooks are combined on the two U-shaped vertical walls, having an upper shove surface, two position plates in parallel having a slot, and the an insert portion formed to extend down from a horizontal portion.

A second feature of the invention is the cap provided with a convex upper surface, and the container having a recessed bottom wall and two opposite crescent grooves at two sides of the recessed bottom so that the convex upper surface of the cap of an upper sealable container can engage the recessed bottom, with the shove surfaces of the cap engaging said two opposite crescent grooves of the container body to stabilize the two sealable container piled up in a stable condition, not easily swaying or falling down even if something may touch or push them by accident.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
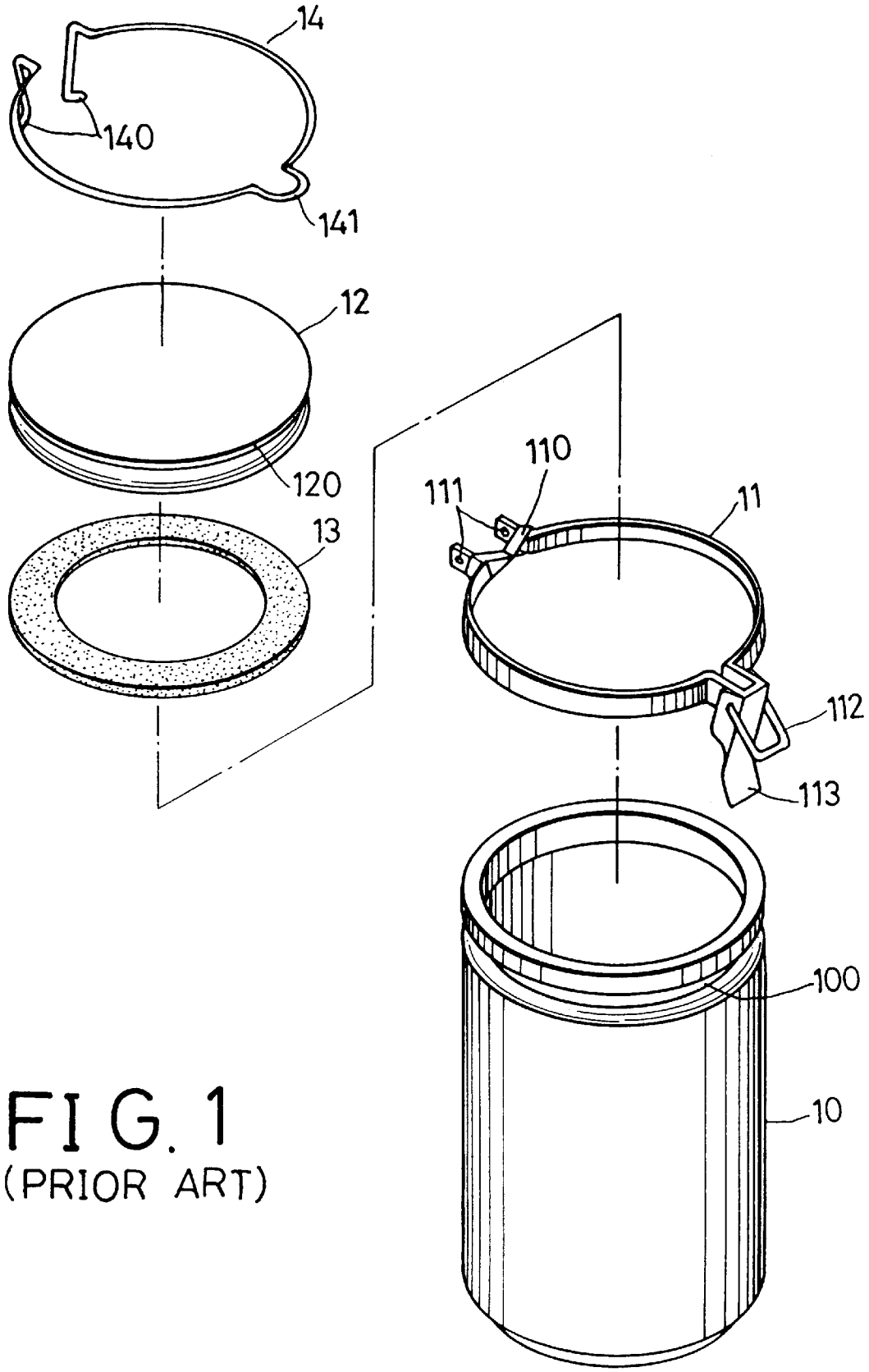
FIG. 1 (PRIOR ART)
FIG. 1 is an exploded perspective view of a known conventional sealable container.
Figure 2:
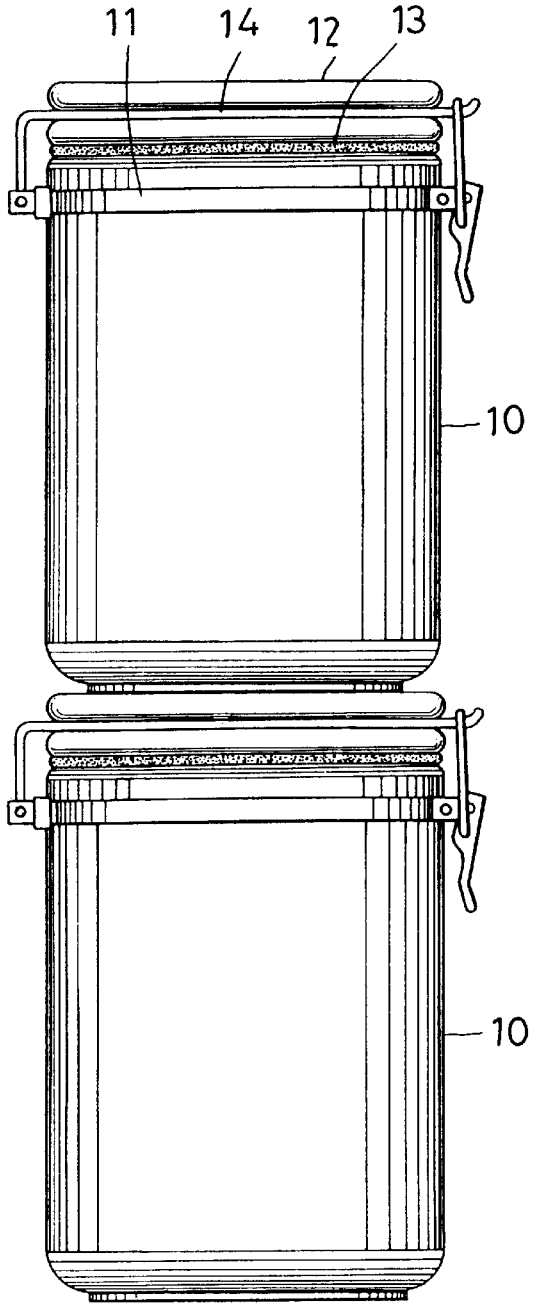
FIG. 2 (PRIOR ART)
FIG. 2 is a side view of the known conventional sealable containers piled up one on the other.
Figure 3:
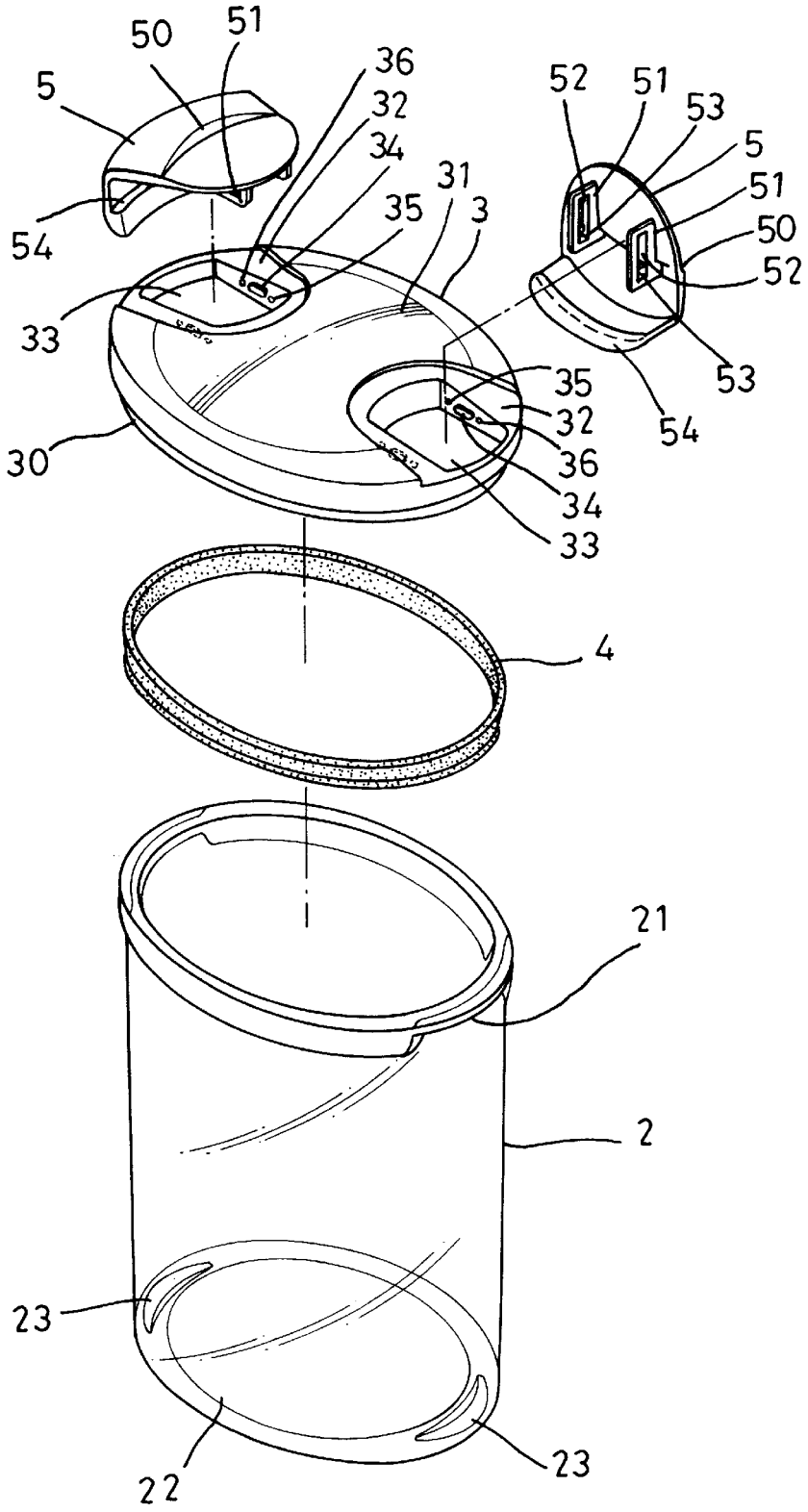
FIG. 3 is an exploded perspective view of a sealable container in the present invention.

A preferred embodiment of a sealable container in the present invention, as shown in FIG. 3, includes a container body 2, a cap 3, a seal gasket 4 and two plate hooks 5 as main components combined together.

The container body 2 has two diametrically oposed curved insert grooves 21 formed in an upper end, a recessed bottom wall 22 formed in the bottom and two opposite crescent grooves 23 formed at two sides of the recessed bottom wall 22.

The cap 3 closes on an upper mouth of the container body 2, having a flange 30 formed on a peripheral bottom edge, a convex surface 31 formed in an upper substantial intermediate surface, and two diametrically opposed U-shaped vertical walls 32. A recess 33 is defined by each U-shaped vertical wall 32, a ridge 34 and two tabs, an inner tab 35 and another tab 36, are at opposite sides of the ridge 34 respectively formed on a right and a left side of each vertical wall 32.

The seal gasket 4 is annular, engaging around the flange 30 of the cap 3.

The two plate hooks 5 are respectively combined on the two U-shaped vertical walls 32, having an inverted L shape, a raised crescent member crescent 50 in a middle section of a horizontal portion, two vertical position plates 51 spaced apart parallel on a lower surface of the horizontal portion, a vertical slot 52 and a small hole 53 under the long slot 52 respectively formed in each vertical position plate 51, and a vertical insert portion 54 formed to extend down from an outer peripheral edge of the horizontal portion.

Figure 4:
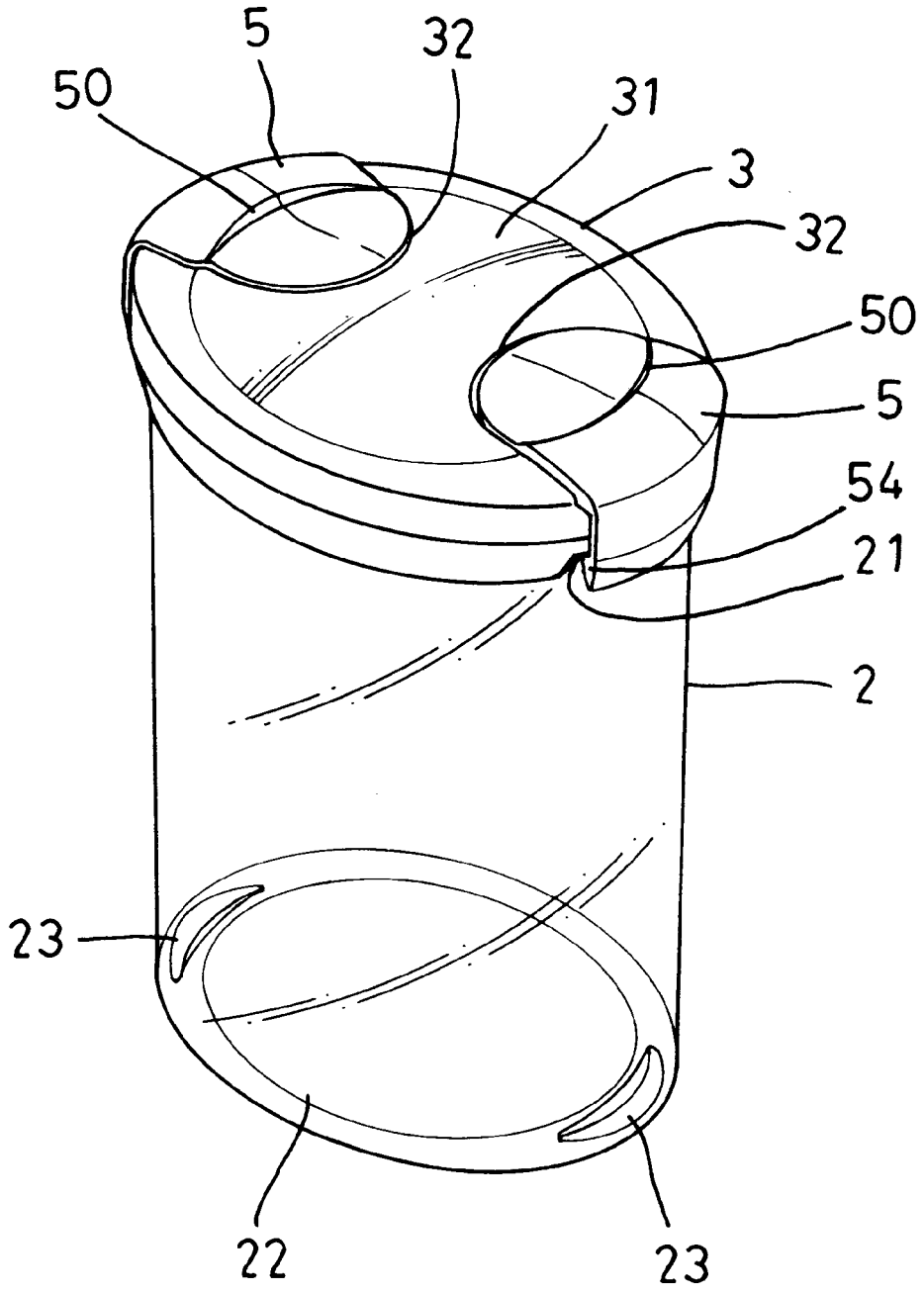
FIG. 4 is a perspective view of the sealable container in the present invention.
Figure 5:
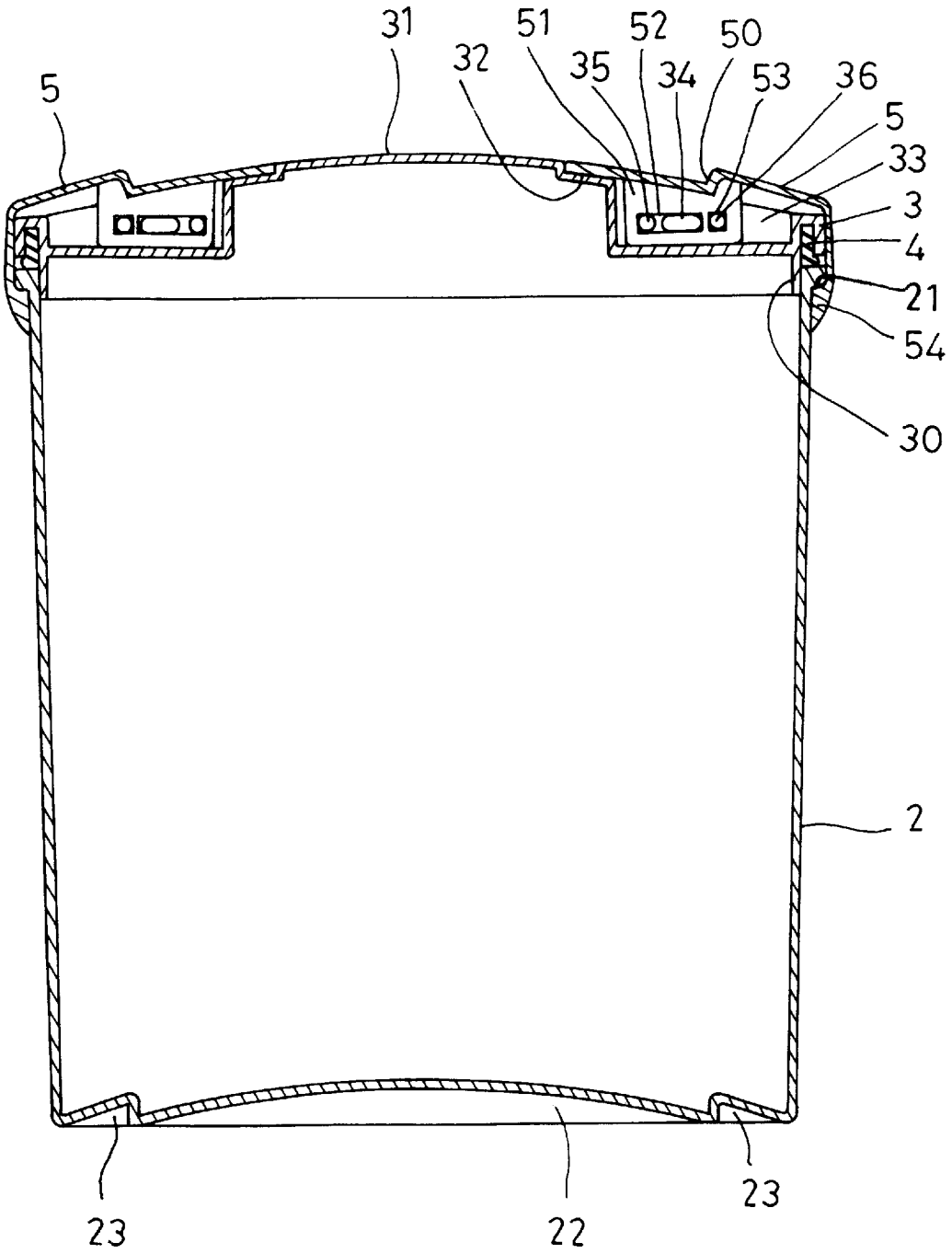
FIG. 5 is a cross-sectional view of the sealable container in the present invention.

In assembling this sealable container, as shown in FIGS. 3, 4 and 5, the seal gasket 4 is fitted around the flange 30 of the cap 3, and the two plate hooks 5 are respectively pressed to fit on the two vertical walls 32 of the cap 3, with the two position plates 51 positioned in the recess 33 of the vertical walls 32, and with the ridge 34 and the tab 35 fitting in the slot 52 and with the tab 36 fitting in the small hole 53. Thus the two plate hooks 5 are combined stabilized with the two U-shaped vertical walls 32 of the cap 3 as shown in FIG. 5. Further, the insert portion 54 of the plate hook 5 fits with the curved grooves 21 of the container 2, thus finishing sealing the cap 3 on the container 2. If the sealed container 2 is desired to be opened, the two plate hooks 5 are pushed outward respectively, forcing the insert portion 54 of each plate hook 5 to disengage from the curved grooves 21 of the container 2. Then the cap 3 can be taken off the container 2 and things stored in the container can be taken out.

Figure 6:
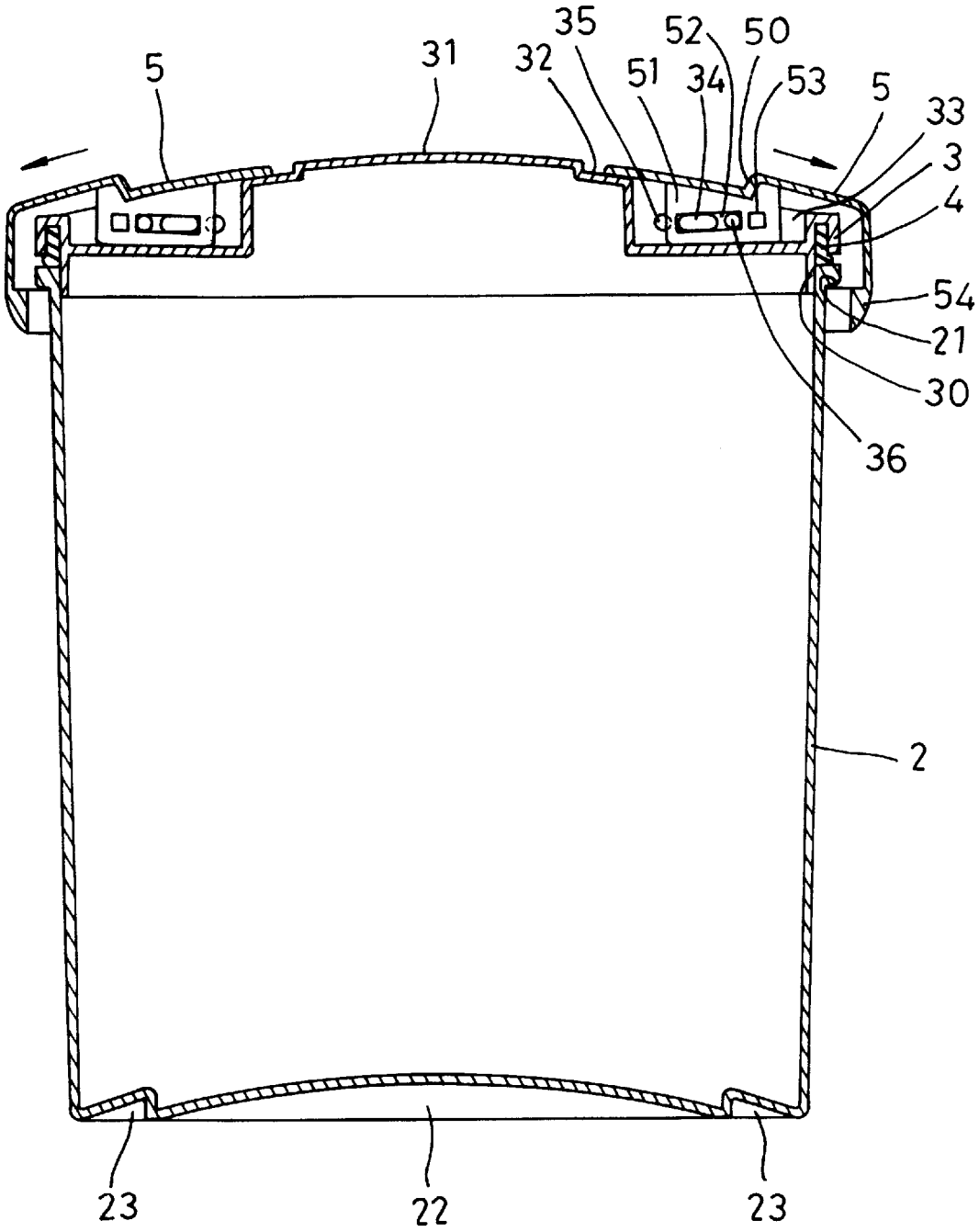
FIG. 6 is a cross-sectional view of two plate hooks being swung open a cap in the present invention; and, FIG. 7 is a cross-sectional view of two sealable containers piled up stabilized in the present invention.

When the plate hooks 5 are pushed outward, the ridge 34 slide in the slot 52 of the position plates 51 with the inner end of the ridge 34 stopped by the inner end of the slot 52, and the tab 36 slides into the slot 52, and the tab 35 is stopped by the wall of the position plate 51 as shown in FIG. 6. Then the plate hooks 5 are stabilized in the opened position, permitting the cap 3 and gasket to be removed from the container 2.

On the contrary, if the container 2 is desired to be sealed with the cap 3, the cap 3 is placed on the upper mouth of the container 2, and the seal gasket 4 is fitted between the upper edge of the container 2 and the bottom of the cap 3 so as to seal the upper mouth of the container 2. Then the two plate hooks 5 are pushed inward, letting the insert portion 54 engage the curved grooves 21, with the ridge 34 on the two side walls of the U-shaped vertical walls 32 sliding in the slot 52 of the position plates 51, with the tab 36 fitting in the small hole 53, as shown in FIG. 5. Thus the plate hooks 5 are stabilized on the U-shaped vertical walls 32, with the container sealed by the cap 3.

Figure 7:
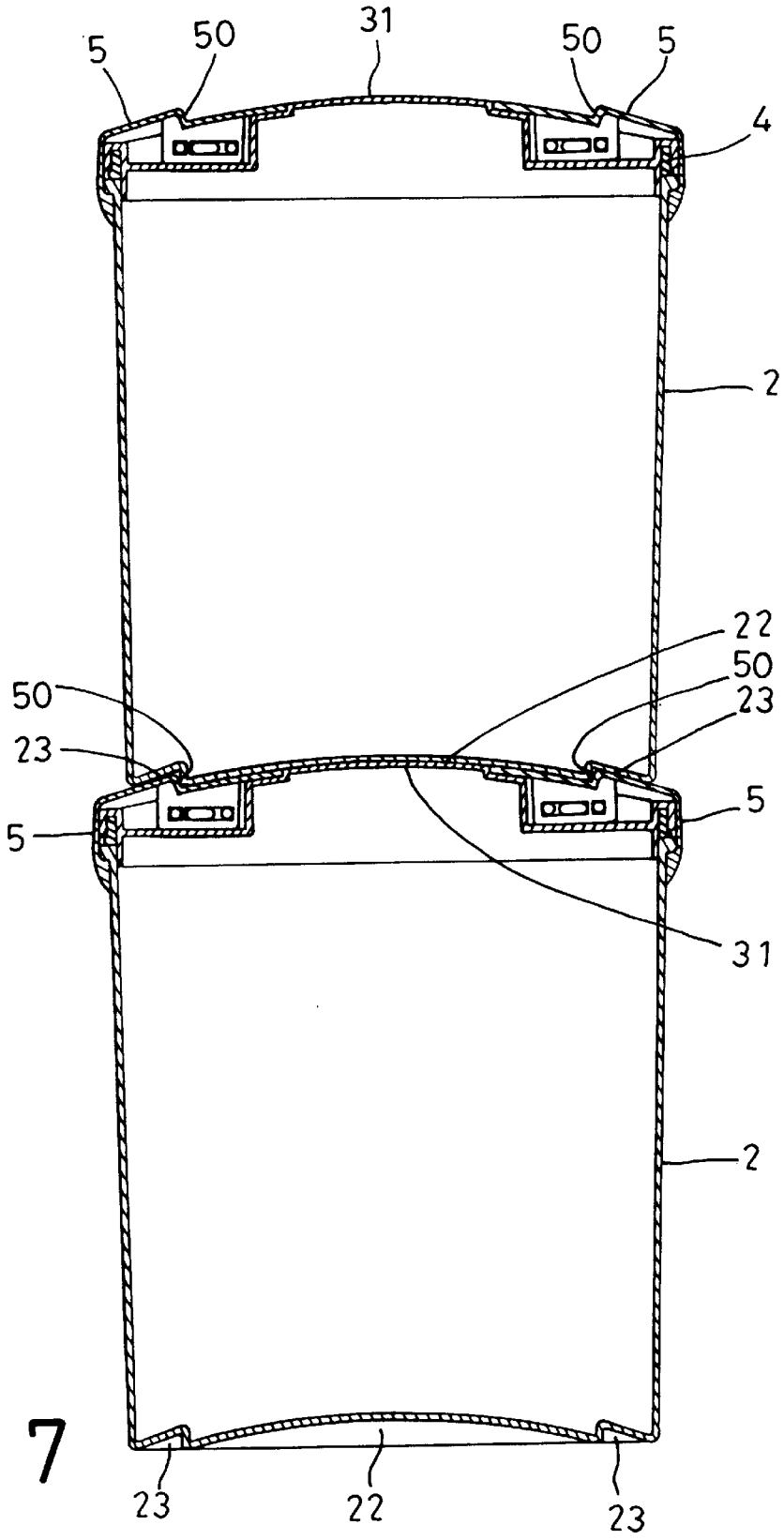

The recessed bottom wall 22 of the bottom of the container 2 conforms to the shape of the convex upper surface 31 of the cap 3. And the two opposite crescent grooves 23 on two sides of the recessed bottom wall 22 can engage with the crescent members 50 of the plate hooks 5. Therefore, if two sealable containers are stacked, the upper one has its recessed bottom wall 22 just fitting with the convex upper surface 31 of a lower one, and further, the two crescent grooves fits with the crescent shove surfaces of the two plate hooks, stabilizing the two containers in a stable condition, so they do not easily sway or tilt or fall down, as shown in FIG. 7.

The sealable container in the invention has the following advantages, as can be understood from the aforesaid description.

1. It is sealed with the cap by means of the two plate hooks which are easy to handle in sealing and opening and is very convenient.

2. The containers can be put up one by one in a stabilized condition, and do not easily sway or tilt or fall down.

3. Its components are simple, convenient to assemble and handy to use.

While the preferred embodiment of the invention has been described above, it will be recognized and understood that various modifications may be made therein and the appended claims are intended to cover all such modifications which may fall within the spirit and scope of the invention.

What is claimed is:

1. A container with detachable sealing cap comprising:

a container body having two diametrically opposed curved grooves formed in an upper end of the body;

a cap for closing the upper end of said body container, the cap having a flange formed in a bottom thereof and;

two diametrically opposed U-shaped vertical walls, a recess defined by each said U-shaped vertical wall, a ridge formed on each of two sides of each U-shaped vertical wall;

an annular seal gasket fitting around said flange;

a plate hook provided on each said U-shaped vertical wall of said cap, each plate hook having a crescent member on an upper surface thereof, a horizontal portion having two position plates in parallel extending down from a lower surface thereof, each said position plate having a slot, and a vertical insert portion extending from an outer peripheral edge of said horizontal portion; and whereby when said plate hooks are pushed inward on said U-shaped vertical walls said vertical insert portions fit in said two curved grooves of said container so that said cap may be kept tightly sealed on an open mouth of said container.

2. The container as claimed in claim 1, wherein each said U-shaped vertical wall includes two opposed side walls, each side wall having a ridge and an inner tab and an outer tab on opposite sides of said ridge, and each position plate of each said plate hook has a slot and a small hole under said slot, said ridge fitting and moving in said slot, said outer tab fitting in said small hole and said inner tab fitting in said slot when each said plate hook is pushed inward, said outer tab sliding in said slot when each said plate hook is pushed outward so as to keep each said plate hook stabilized in an open position.

3. The container of claim 1 wherein the cap is provided with a convex upper surface, the container body is provided with a recessed bottom wall in a bottom thereof and two diametrically opposed crescent grooves are provided at two sides of said recessed bottom wall, each plate provided with a crescent member on an upper surface thereof, whereby the recessed bottom wall of an one container being stackable on the convex upper surface of another container to dispose the crescent members of the another container within the crescent grooves of the one container for stabilizing the container in a stacked condition.

* * * * *